US008151724B2

(12) United States Patent
Tsai

(10) Patent No.: US 8,151,724 B2
(45) Date of Patent: Apr. 10, 2012

(54) RUDDER ASSEMBLY FOR AN INFLATION BOAT

(75) Inventor: Chun-Chung Tsai, Dongguan (CN)

(73) Assignee: Dongguan Tiger Point, Metal & Plastic Products Co., Ltd., Guang Dong Province (CN)

( * ) Notice: Subject to any disclaimer, the term of this patent is extended or adjusted under 35 U.S.C. 154(b) by 78 days.

(21) Appl. No.: 12/777,239

(22) Filed: May 10, 2010

(65) Prior Publication Data

US 2011/0271890 A1 Nov. 10, 2011

(51) Int. Cl.
*B63H 25/06* (2006.01)

(52) U.S. Cl. ..... 114/162; 114/140; 441/79

(58) Field of Classification Search ..... 114/132, 114/162, 130, 140; 441/74, 79
See application file for complete search history.

(56) References Cited

U.S. PATENT DOCUMENTS 4,846,745 A * 7/1989 Lobe ..... 441/79
4,964,826 A * 10/1990 Lobe ..... 441/79

* cited by examiner

*Primary Examiner* — Lars A Olson
(74) *Attorney, Agent, or Firm* — Hershkovitz & Associates, LLC; Abraham Hershkovitz

(57) ABSTRACT

A rudder assembly for a boat has a securing base, a rudder board and at least one engaging bolt. The rudder board is mounted detachably on the securing base and has a bottom and two rudder hooks. The rudder hooks are formed respectively on two ends of the bottom and are connected securely to the securing base with the at least one engaging bolt. The at least one engaging bolt is mounted detachably on the securing base and engages respectively at least one of the rudder hooks on the rudder board. Accordingly, a rudder board can be conveniently detached from the securing base even while an inflating boat is at an inflated condition.

2 Claims, 5 Drawing Sheets

RUDDER ASSEMBLY FOR AN INFLATION BOAT

BACKGROUND OF THE INVENTION

1. Field of the Invention

The present invention relates to a rudder assembly, and more particularly to rudder assembly for an inflating boat and that can be conveniently detached from the inflating boat while the inflating boat is at an inflated condition.

2. Description of Related Art

An inflating boat is widely used in water activities, such as patrolling, lifesaving or fishing and is easily stored and carried after the boat is flatted. Additionally, an inflating boat has a rudder mounted on a bottom of the boat to control the travel direction of the boat. With reference to FIG. 5, a conventional rudder comprises a securing base 40 and a rudder board 50. The securing base 40 is mounted securely on the bottom of the boat and has two base hooks 41 formed in the securing base 40. The rudder board 50 has two rudder hooks 51 formed on the rudder board 50 and engaging respectively the base hooks 41 in the securing base 40. With the engagements between the hooks 41,51, the rudder board 50 is mounted securely on the securing base 10. After the boat is flatted, the rudder board 50 can be detached from the securing base 40 to reduce the space for storing or carrying the flatted boat.

However, to disengage the hooks 41,51 on the securing base 40 and rudder board 50 from each other, to twist and deform of the securing base 41 is necessary but the securing base 40 is not easily or even cannot be deformed while the boat is at an inflated condition. Therefore, to detach the rudder board 50 from the securing base 40, the boat has to be inflated firstly, but this causes inconvenience.

To overcome the shortcomings, the present invention tends to provide a rudder assembly to mitigate or obviate the aforementioned problems.

SUMMARY OF THE INVENTION

The main objective of the invention is to provide a rudder assembly that can be conveniently detached from the inflating boat while the inflating boat is at an inflated condition.

The rudder assembly has a securing base, a rudder board and at least one engaging bolt. The rudder board is mounted detachably on the securing base and has a bottom and two rudder hooks. The rudder hooks are formed respectively on two ends of the bottom and are connected securely to the securing base with the at least one engaging bolt. The at least one engaging bolt is mounted detachably on the securing base and engages respectively at least one of the rudder hooks on the rudder board.

Other objects, advantages and novel features of the invention will become more apparent from the following detailed description when taken in conjunction with the accompanying drawings.

DETAILED DESCRIPTION OF PREFERRED EMBODIMENT

Figure 1:
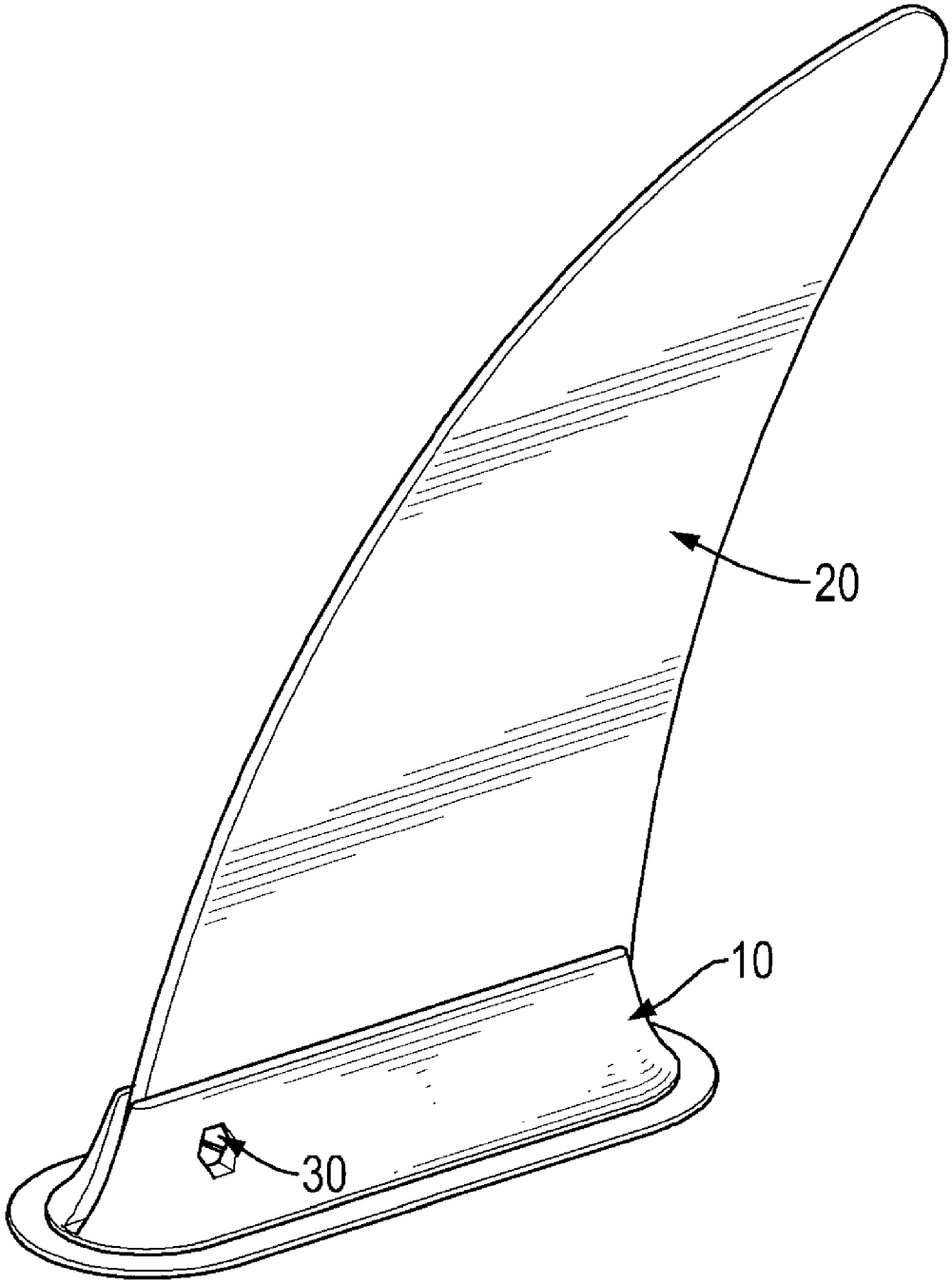
FIG. 1 is a perspective view of a rudder assembly in accordance with the present invention.
Figure 2:
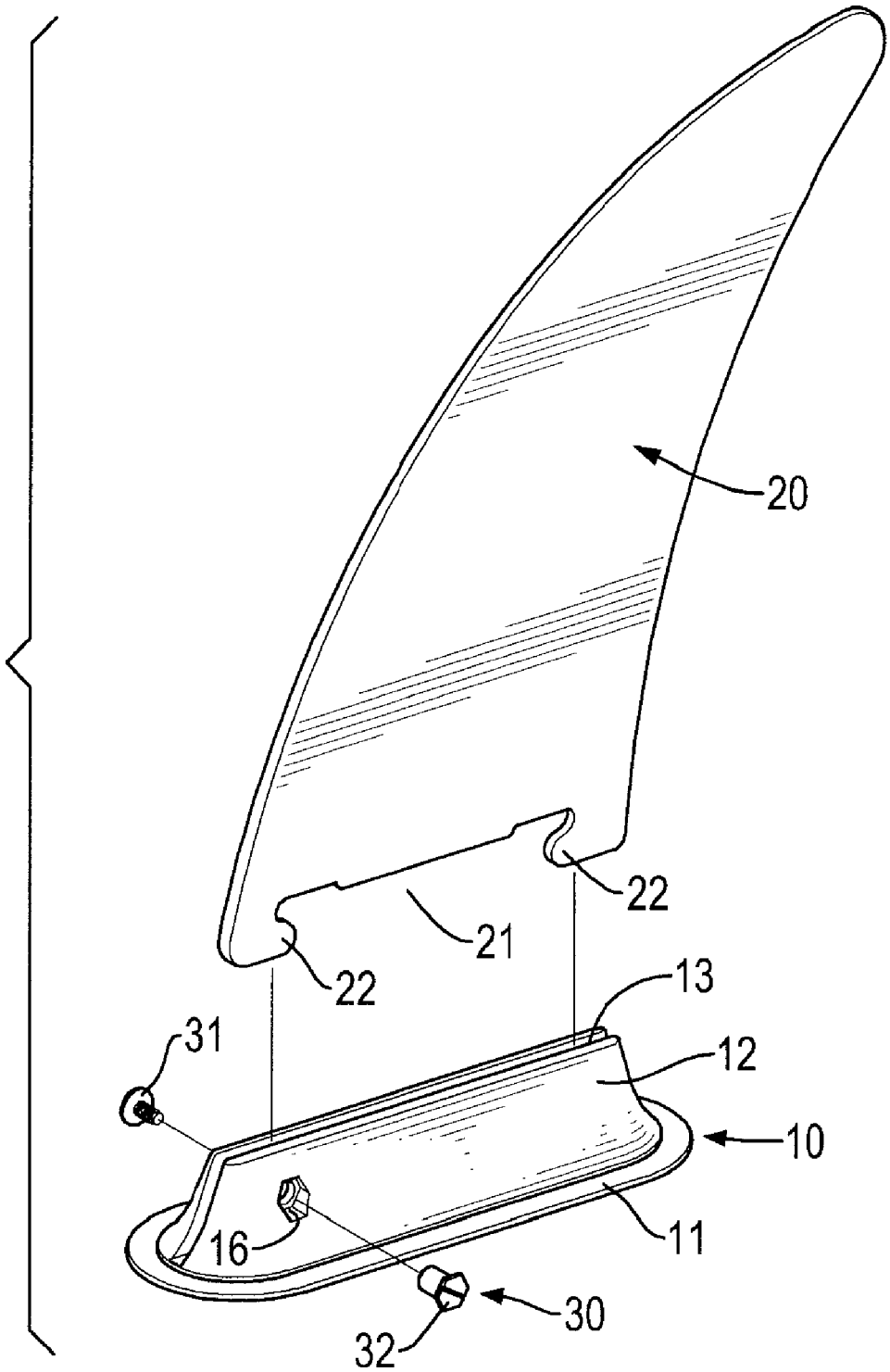
FIG. 2 is an exploded perspective view of the rudder assembly in FIG. 1.
Figure 3:
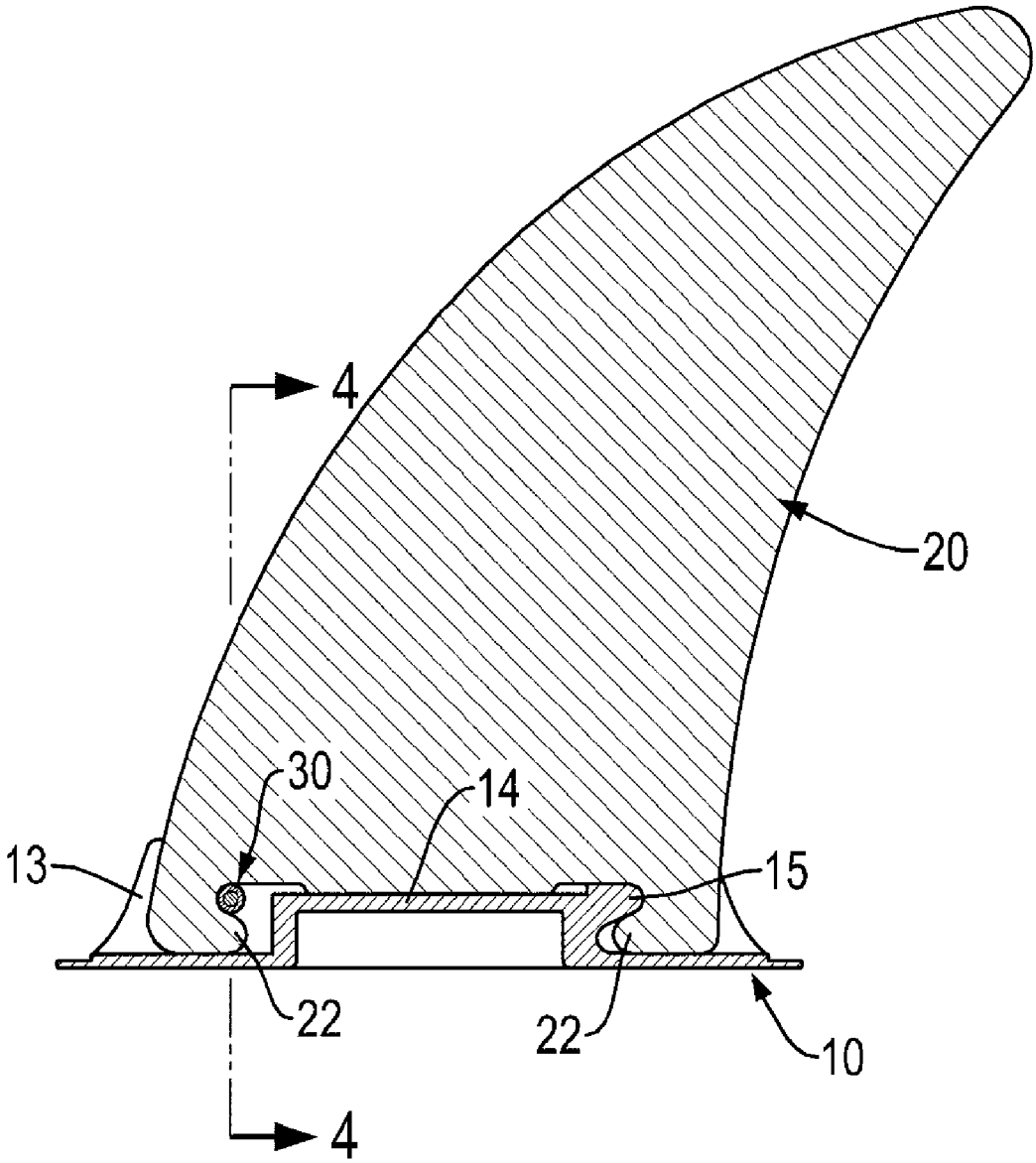
FIG. 3 is a cross sectional side view of the rudder assembly in FIG. 1.
Figure 4:
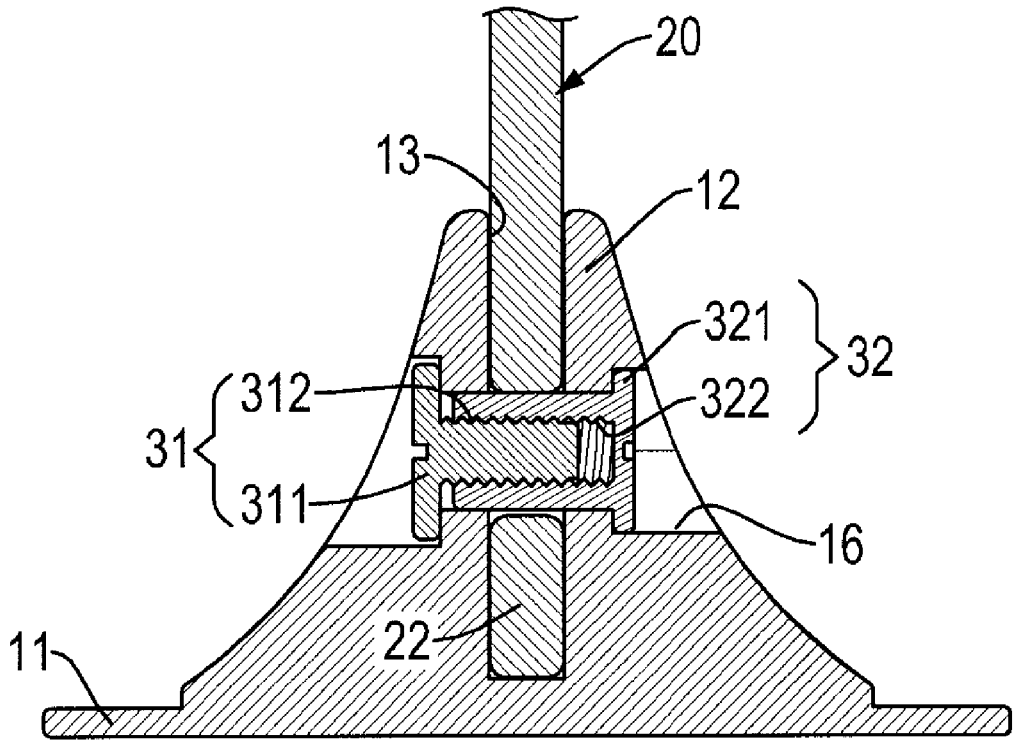
FIG. 4 is an enlarged cross sectional end view of the rudder assembly along line 4-4 in FIG. 3.
Figure 5:
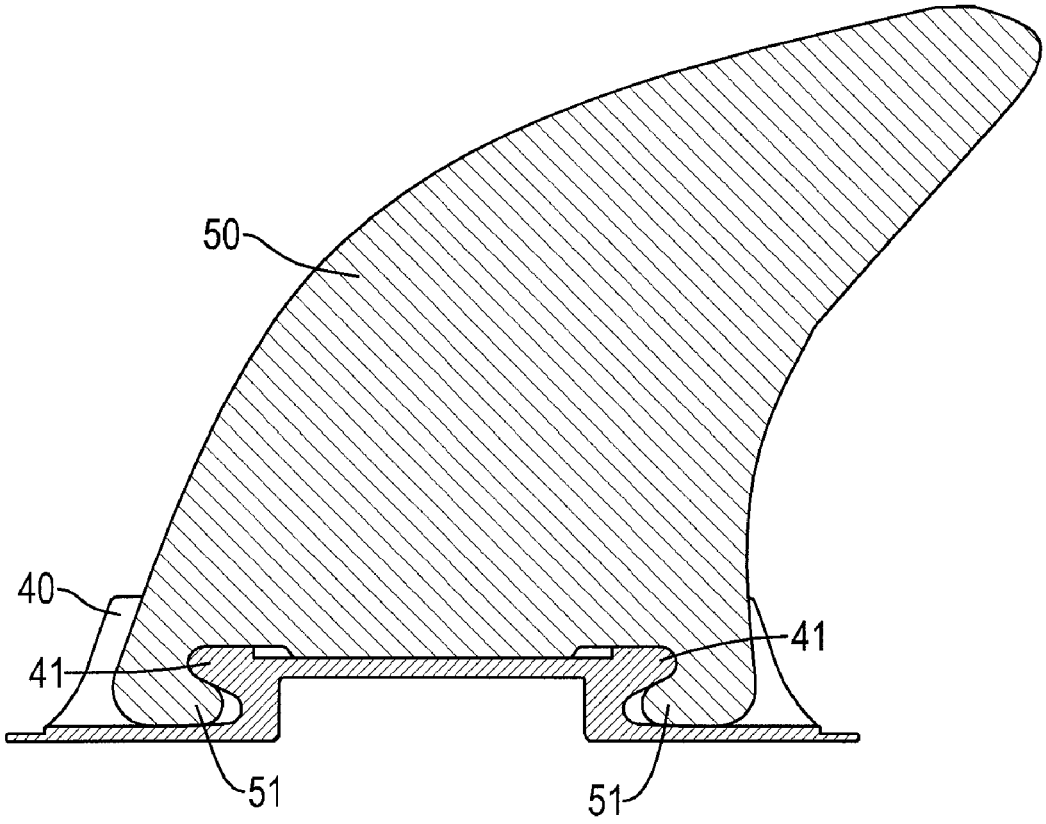
FIG.5 PRIOR ART
FIG. 5 is a cross sectional side view of a conventional rudder for an inflating boat in accordance with the prior art.

With reference to FIGS. 1 to 4, a rudder assembly for a boat in accordance with the present invention comprises a securing base 10, a rudder board 20 and an engaging blot 30.

The securing base 10 is mounted securely on a bottom of the boat and comprises a base board 11, a board mount 12, a holding recess 13, an engaging bracket 14, a base hook 15 and a through hole 16.

The base board 11 is elongated and is mounted securely on the bottom of the boat. The board mount 12 is formed on and protrudes from the top of the base board 11, is elongated and has a length shorter than that of the base board 11. The holding recess 13 is defined in the top of the board mount 12 and has an opening defined in the top of the board mount 12 and a bottom surface. The engaging bracket 14 is mounted in the holding recess 13 and is formed on and protrudes from the bottom surface of the holding recess 13. The base hook 15 is formed in the holding recess 13 and is preferably formed on and protrudes from one end of the engaging bracket 14. The through hole 16 is defined through the board mount 12 at a position adjacent to but away from an end of the engaging bracket 14 opposite to the base hook 15 and communicates with the holding recess 13.

The rudder board 20 is mounted detachably on the securing base 10, is connected securely to the securing base 10 with the engaging bolt 30 and has a bottom and two rudder hooks 22. The bottom of the rudder board 20 has two ends and a length shorter than that of the board mount 12 of the securing base 10. The rudder hooks 22 are formed respectively on the ends of the bottom, protrude toward each other to define a notch 21 between the rudder hooks 22 for mounting the engaging bracket 14 inside. The rudder hooks 22 are connected to the securing base 10 respectively with the base hook 15 and the engaging bolt 30

The engaging bolt 30 is mounted detachably on the securing base 10, is mounted in the through hole 16 in the securing base 10 and engages a first one of the rudder hooks 22 on the rudder board 20. The second one of the rudder hooks 22 on the rudder board 20 engages the base hook 15 in the securing base 10. The engaging bolt 30 comprises a female element 32 and a male element 31. The female element 32 engages the first rudder hook 22 on the rudder board 20 and has a head 321 and a threaded hole 322 defined in an end opposite to the head 321 of the female element 32. The male element 31 has a head 311 and a threaded rod 312 formed on and protruding from the head 311 of the male element 31 and screwed into the threaded hole 321 in the female element 32.

To mount the rudder board 20 onto the securing base 10, the bottom of the rudder board 20 is inserted into the holding recess 13 via the opening in the board mount 12 of the securing base 10. The second rudder hook 22 corresponding to the base hook 15 engages the base hook 15, and the first rudder hook 22 is at a position corresponding to the through hole 16. The male and female elements 31,32 of the engaging bolt 30 are inserted into the through hole 16 from two ends of the hole 16 and are screwed with each other to make the female element 32 engaging the first rudder hook 22 on the rudder board 20. Accordingly, the rudder board 20 is mounted securely on the securing base 10 with the hooks 15,22 and the engaging bolt 30.

To detach the rudder board 20 from the securing base 10, the male and female elements 31,32 of the engaging bolt 30 are unscrewed from each other, such that the female element 32 can be disengage essentially from the first rudder hook 22 on the rudder board 20. Consequently, the rudder board 20 can be slid in the holding recess 13 to disengage the second rudder hook 22 from the base hook 15 to allow the rudder board 20 to be detached from the holding recess 13 in the securing base 10. Accordingly, the rudder board 20 can be easily and conveniently detached from the securing base 10 even while the boat is at a completely inflated condition. To flat an inflating boat for detaching the rudder assembly is unnecessary, so the operation and assemble of the rudder assembly in accordance with the present invention is convenient.

Alternatively, two engaging bolts 30 are implemented and the base hook 14 can be omitted. In this alternative embodiment, two through holes 16 are defined in the securing base 10 and the engaging bolts 30 are mounted respectively in the through holes 16. The rudder hooks 22 on the rudder board 20 engage respectively the engaging bolts 30 to mount the rudder board 20 securely on the securing base 10 with the engagements between the hooks 22 and the engaging bolts 30.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rudder assembly comprising:

a securing base; and a rudder board mounted detachably on the securing base and having a bottom having two ends; and two rudder hooks formed respectively on the ends of the bottom, extending toward each other, wherein a single engaging bolt is mounted detachably on the securing base and engages a first one of the rudder hooks on the rudder board, and wherein the securing base has a top;

an elongated holding recess defined in the top of the securing base to hold the bottom and the rudder hooks of the rudder board inside and having an opening in the top of the securing base and a bottom surface;

an engaging bracket formed on and protruding from the bottom surface of the holding recess; and a base hook formed on and protruding from one end of the engaging bracket and engaging a second one of the rudder hooks on the rudder board.

2. The rudder assembly as claimed in claim 1, wherein the engaging bolt comprises:

a female element engaging the first rudder hook on the rudder board and having a head and a threaded hole defined in an end opposite to the head of the female element; and a male element having a head and a threaded rod formed on and protruding from the head of the male element and screwed into the threaded hole in the female element.

* * * * *